US006466903B1

(12) United States Patent
Stylianou

(10) Patent No.: US 6,466,903 B1
(45) Date of Patent: Oct. 15, 2002

(54) SIMPLE AND FAST WAY FOR GENERATING A HARMONIC SIGNAL

(75) Inventor: Ioannis G Stylianou, Madison, NJ (US)

(73) Assignee: AT&T Corp., Basking Ridge, NJ (US)

( * ) Notice: Subject to any disclaimer, the term of this patent is extended or adjusted under 35 U.S.C. 154(b) by 0 days.

(21) Appl. No.: 09/564,437

(22) Filed: May 4, 2000

(51) Int. Cl.[7] ..... G10L 11/04
(52) U.S. Cl. ..... 704/207; 704/209
(58) Field of Search ..... 704/207, 200, 704/201, 205, 209

(56) References Cited

U.S. PATENT DOCUMENTS

| | | | | | |
|---|---|---|---|---|---|
| 4,018,121 | A | * | 4/1977 | Chowning | 84/101 |
| 4,294,153 | A | * | 10/1981 | Mitsuhashi | 84/624 |
| 4,554,855 | A | * | 11/1985 | Alonso et al. | 84/622 |
| 4,649,783 | A | * | 3/1987 | Strong et al. | 84/606 |
| 5,536,902 | A | * | 7/1996 | Serra et al. | 84/623 |
| 6,057,498 | A | * | 5/2000 | Barney | 84/199 |

* cited by examiner

*Primary Examiner*—Richemond Dorvil
(74) *Attorney, Agent, or Firm*—Henry Brendzel

(57) ABSTRACT

A fast and accurate method for generating a sampled version of the signal $$h(t) = \sum_{k=1}^{K} A_k \cos(k\omega_o t + \varphi_k),$$

is achieved by retrieving from memory a pre-computed phase delay value corresponding to $\phi_k$ for a given fundamental frequency, expressed in numbers of samples, for a running value of the index k, subtracting it from a sample time index, t, that is multiplied by the value of k, and employing the subtraction result, expressed in a modulus related to the fundamental frequency, to retrieve a pre-computed sample value of cosine $\cos(k\omega_o t)$ for the given fundamental frequency. The retrieved sample is multiplied by a retrieved coefficient $A_k$ corresponding to the value of k and to the given fundamental frequency, and placed in an accumulator. The value of k is incremented, and the process for the sample value corresponding to the value of time sample t is repeated until the process completes for k=K.

10 Claims, 1 Drawing Sheet

SIMPLE AND FAST WAY FOR GENERATING A HARMONIC SIGNAL

BACKGROUND OF THE INVENTION

This invention related to speech, and more particularly, to speech synthesis.

Harmonic models were found to be very good candidates for concatenative speech synthesis systems. These models are required to compress the speech database and to perform prosodic modifications where necessary and, finally, to ensure that the concatenation of selected acoustic units results in a smooth transition from one acoustic unit to the next. The main drawback of harmonic models is their complexity. High complexity is a significant disadvantage in real applications of a TTS system where it is desirable to run as many parallel channels are possible on inexpensive hardware. More than 80% of the execution time of synthesis that is based on harmonic models is spent on generating a synthetic (harmonic) signal of the form $$h(t) = \sum_{k=1}^{K} A_k \cos(k\omega_o t + \varphi_k) \tag{1}$$

where $$K = \frac{(f_s/2)}{f_o},\ f_s$$

is the sampling frequency, $f_0$ is the fundamental frequency of the desired harmonic signal in Hz., $\omega_o$ the fundamental frequency of the desired harmonic signal in radians, k is the harmonic number, amplitude coefficients $A_k$ for fundamental $\omega_o$ are given, and so are the phase $\phi_k$ for fundamental $\omega_o$.

There are a number of prior art approaches for generating the signal of equation (1). The straight-forward approach directly synthesizes each of the harmonics, multiplies the synthesized signal by the appropriate coefficient, shifts the appropriate phase offset, and adds the created signal to an accumulated sum. Although modern computers have programs for quickly evaluating trigonometric functions, creating the equation (1) signal is nevertheless quite expensive. Another approach that can be taken employs an FFT. The FFT, however, creates a number of frequency bins that is a power of 2, but the number of harmonics may not be such a number. In such a case, the frequency bin that is closest to the desired frequency can be assigned but, of course, an error is generated. The bigger the size of the FFT, the smaller the error, but the bigger the size of the FFT the more processing is required (which takes resources; e.g., time).

Still another approach that can be taken is to employ recurrence equations. Trigonometric functions whose arguments form a linear sequence of the form $$\theta=\theta_0+n\delta \text{ with } n=0, 1, 2, \ldots,$$

are efficiently calculated by the following recurrence:

$$\cos(\theta+\delta)=\cos\theta-[\alpha\cos\theta+\beta\sin\theta]$$

$$\sin(\theta+\delta)=\sin\theta+[\alpha\sin\theta-\beta\cos\theta]$$

where $\alpha$ and $\beta$ are the pre-computed coefficients $$\alpha = 2\sin^2\left(\frac{\delta}{2}\right)$$

$\beta=\sin\delta$.

For each harmonic, k, the coefficients $\alpha_k$ and $\delta_k$ have to be computed, where $\delta_k=k\omega_o$. The above works adequately only when the increment $\delta$ is small.

SUMMARY OF THE INVENTION

A fast and accurate method for generating a sampled version of the signal $$h(t) = \sum_{k=1}^{K} A_k \cos(k\omega_o t + \varphi_k),$$

is achieved by pre-computing, for each harmonic k a phase delay corresponding to $\phi_k$, expressed in a number of sample delays, for each fundamental frequency $\omega_o$, of interest, and storing the pre-computed values in memory. Also pre-computed and stored in memory are sample values of $\cos(k\omega_o t)$ and coefficients $A_k$ for each fundamental frequency $\omega_o$ of interest. In operation, a sample of h(t) is generated for a given a fundamental frequency by first setting an index k to 1, retrieving the phase delay value corresponding to the value of k and to the given fundamental frequency, subtracting it from a sample time index, t, that is multiplied by the value of k, and employing the subtraction result, expressed in a modulus related to the fundamental frequency, to retrieve a sample value of cosine $\cos(k\omega_o t)$ for the given fundamental frequency. The retrieved sample is multiplied by a retrieved coefficient $A_k$ corresponding to the value of k and to the given fundamental frequency, and placed in an accumulator. The value of k is incremented, and the process is repeated until the process completes for k=K.

BRIEF DESCRIPTION OF THE DRAWING

The sole FIGURE depicts a block of an arrangement for efficiently generating a signal for Concatenative speech synthesis systems.

DETAILED DESCRIPTION

Figure 1:
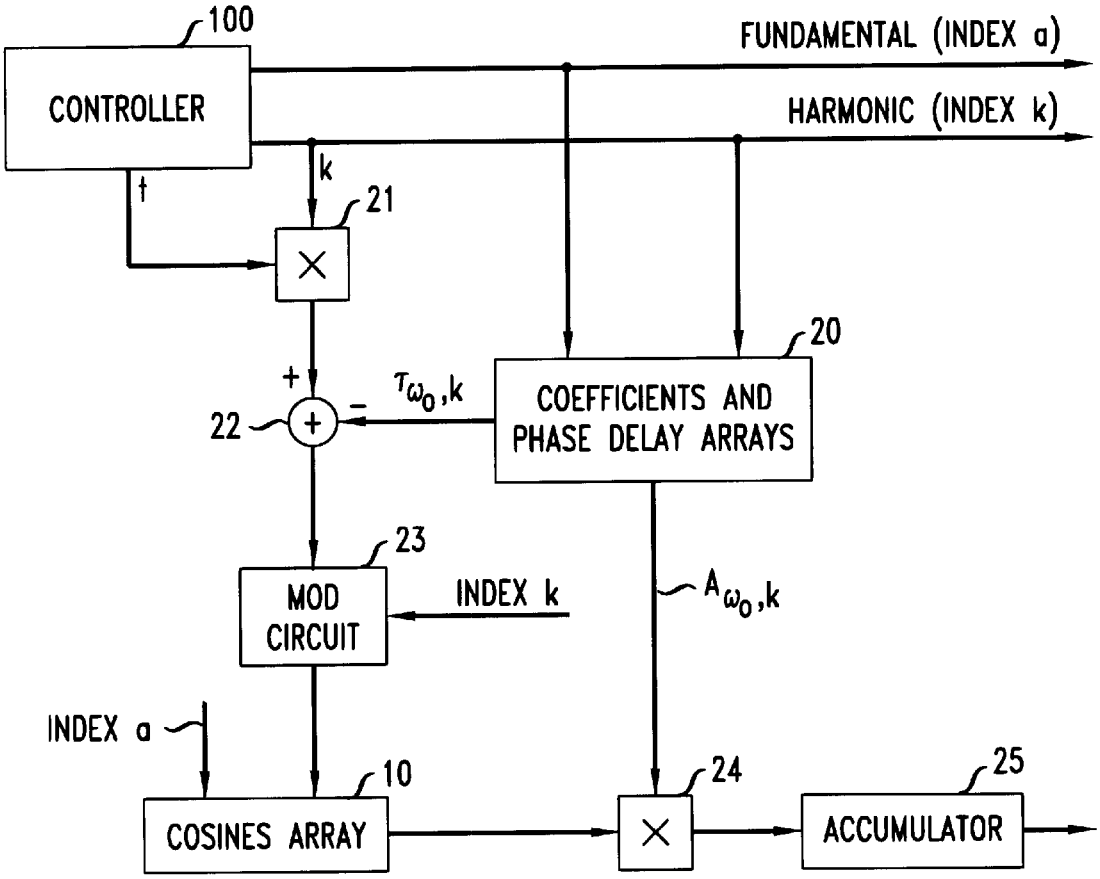

Considering equation (1), the phase information can be converted to a phase delay. Specifically, the phase delay, $\tau_k$, of the $k^{th}$ harmonic is $$\tau_k=-\phi(k\omega_o)/k\omega_o \tag{2}$$

where $\phi(k\omega_o)$ corresponds to $\phi_k$ of equation (1). The phase delay $\tau_k$ is expressed in terms of a number of samples, rounded to the nearest integer, and therefore, is less sensitive to quantization errors. For example, with a sampling frequency of 16 KHz and with a fundamental frequency of 100 Hz, a phase of $3\pi/4$ radians corresponds to $$\frac{16000}{100}\cdot\frac{3\pi/8}{2\pi} = 30$$

samples.

Based on the equation (2) transformation, equation (1) can be replaced by the following:

$$h(t) = \sum_{k=1}^{K} A_{\omega_o,k} X[(k\omega_o t - \tau_{\omega_o,k}) \bmod T_{w_o}] \quad (3)$$

where "mod" stands for modulo, $T_{\omega_0}$ is the integer pitch period of fundamental frequency $\omega_o$ (in samples), and X denotes the sampled cosine function $$X(t)=\cos(t\omega_o), t=0, 1, 2, \ldots T_{\omega_0}-1 \quad (4)$$

The sole presented Figure depicts a block diagram of an arrangement for efficiently creating the equation (1) signal for any fundamental frequency. At the heart of the embodiment is memory 10, which stores a matrix of cosine samples $$\begin{bmatrix} X_{\omega_1}(t) \\ X_{\omega_2}(t) \\ M \\ X_{\omega_N}(t) \end{bmatrix}$$

for a selected number of fundamental frequencies, for example, from 40 Hz to 500 Hz. Each vector $X_{\omega_0}$ (t) has one pitch period's worth of samples, which means that each vector $X_{\omega_o}$ (t) has a different number of elements. For example, when the sampling frequency is 16,000 Hz, the vector $X_{40\ Hz}$(t) has 400 samples. Viewed differently, memory 10 stores values of the $X_{\omega_0}$(t) samples in an array X(a,t), where a is the index that points to a selected value of $\omega_o$. For example, a=0 may point to the array that corresponds to $\omega_o$=40 Hz, a=1 may point to the array that corresponds to $\omega_o$=41 Hz, etc. The index t corresponds to sample number of the developed signal h(t), and in connection with array X(a,t), the index t, employed in modulo $T_{\omega_0}$ form, corresponds to sample number of the sampled cosine signal.

In addition to memory 10, there is memory 20, which stores signal vectors T($\omega_i$,k) and A($\omega_i$,k) in arrays T(a,b) and A(a,k), respectively, and memory 30, is which stores pre-computed values of $\omega_i/\omega_o$. With respect to memory 20, as with the $X_{\omega_i}$(t) vectors, the number of elements in each vector differs. Specifically, the $k^{th}$ element of the $i^{th}$ vector in T($\omega_i$,k) corresponds to $\tau_k$ for fundamental frequency $\omega_i$ and the number of elements, $K_i$, is as indicated above; that is, $$K_i = \frac{(f_s/2)}{f_i}.$$

Similarly, the $k^{th}$ element of the $i^{th}$ vector in A($\omega_i$,k) corresponds to $A_k$ for fundamental frequency $\omega_i$.

To develop the equation (3) signal for a given fundamental frequency, $\omega_j$, controller 100 of the presented Figure outputs an index a signal that is set to j. This index signal, corresponding to the desired fundamental frequency, is applied to memories 10 and 20. In memory 10, the index causes the vector $X_{\omega_j}$(t) to be selected, and in memory 20 the index causes the vectors $A_k$ and $\tau_k$ for frequency $\omega_j$ to be selected. Controller 100 also outputs a time-sequence signal on lead 101 that corresponds to ck, where c=1, 2, 3 . . . .

This signal continually increments in multiples of the harmonic index b. That is, as index b is stepped by controller 100 from 0 to $K_i$, summer 35 adds the value of $\tau_k$ to index b and applies the sum b'=b+$\tau_k$ to multiplier 36. Multiplier 36 multiplies b' by $j^{th}$ row in the arrays of memories 20 and 30 to be accessed, as well as the $j^{th}$ entry in memory 40, which contains the pre-computed value $\omega_j/\omega_o$. Controller 10 also outputs a sequence of harmonic signals, index b, where b=0, 1,2, 3 . . . $K_i$, which signals are applied to memories 20 and 30 and to summer 35 wherein the value of $\tau_k$ is added, yielding an index value b'=b+$\tau_k$. The output of summer 35 is applied to multiplier 36, as is the output of memory 40, yielding the product $$b'\frac{\omega_j}{\omega_o}.$$

What is claimed is:

1. A method executed in a computing apparatus for generating a time sample of a signal h(t) for sample time t, where $$h(t) = \sum_{k=1}^{K} A_k \cos(k\omega_o t + \varphi_k),$$

for a given fundamental frequency $\omega_o$, when the set $A_k$, k=1, 2, . . . K is given for said fundamental frequency, and the set $\tau_k$, k=1, 2, . . . K is given for said fundamental frequency, where $\tau_k$ is related to $\phi_k$ through said fundamental frequency, comprising the steps of:

setting index k to 1;

retrieving from memory the value of $\tau_k$ corresponding to index k;

developing a number corresponding to $[tk-\tau_k]_{modT}$ where T is related to said fundamental frequency;

employing said number to develop a cosine sample at said fundamental frequency;

multiplying said cosine sample by a coefficient $A_k$ corresponding to index k that is retrieved from memory;

accumulating results of said step of multiplying;

while k is less than K−1, incrementing k and returning to said step of retrieving;

when k is equal to K, assigning results of said accumulating to said h(t).

2. The method of claim 1 where said step of developing a cosine sample from said number comprises retrieving a pre-computed cosine sample from memory.

3. The method of claim 1 further comprising a step of selecting a fundamental frequency.

4. The method of claim 3 where said step of selecting a fundamental frequency is effected by focusing said retrieving of $\tau_k$ from memory, retrieving of $A_k$ from memory and retrieving sad cosine sample from memory on sections of memory that contain information related to said fundamental frequency.

5. The method of claim 1 further comprising incrementing the value of t and repeating said steps of setting index k to 1 through assigning results of said accumulating to said h(t).

6. The method of claim 1 further comprising computing, and storing in memory, values of $\tau_k$ from given values of $\phi_k$, where $\tau_k$=−$\phi$(k$\omega_o$)/k$\omega_o$, rounded to the nearest integer.

7. Apparatus comprising:

a controller for developing an index signal t and an index signal k;

a memory for storing coefficients $A_k$ for a selected fundamental frequency $\omega_o$, responsive to said index signal k;

a memory for storing delay values $\tau_k$ for said fundamental frequency $\omega_o$, responsive to said index signal k;

a computing circuit responsive to said index signal t, said index signal k, and to output signal of said memory for storing delay values;

a memory for storing sample values of cosine for said selected fundamental frequency;

a multiplier responsive to output signal of said memory for storing coefficients and to output signal of said memory for storing sample values of cosine; and an accumulator responsive to said multiplier.

8. The apparatus of claim 7 where said computing circuit develops a number corresponding to $[tk-\tau_k]_{modT}$ where T is related to said fundamental frequency.

9. The apparatus of claim 7 where said computing circuit comprises a multiplier responsive to said index signal t and said index signal k, a subtractor responsive to said multiplier of said computing circuit and to said output signal of said memory for storing delay values, and a circuit for developing a remainder of the number developed by said subtractor, when that number is divided by T, where T is related to said fundamental frequency.

10. The apparatus of claim 7 wherein said controller develops a signal corresponding to said fundamental frequency, and said memory for storing coefficients $A_k$, said memory for storing delay values $\tau_k$, said computing circuit responsive, and said memory for storing sample values of cosine are all responsive to said signal corresponding to said fundamental frequency.

* * * * *